US011653773B2

(12) United States Patent
Wang

(10) Patent No.: US 11,653,773 B2
(45) Date of Patent: May 23, 2023

(54) DETACHABLE BABY BOUNCER

(71) Applicant: La-Di-Da Baby Toy Co., Ltd, Shaoguan (CN)

(72) Inventor: Junru Wang, Shaoguan (CN)

(73) Assignee: La-Di-Da Baby Toy Co., Ltd, Shaoguan (CN)

( * ) Notice: Subject to any disclaimer, the term of this patent is extended or adjusted under 35 U.S.C. 154(b) by 2 days.

(21) Appl. No.: 17/550,407

(22) Filed: Dec. 14, 2021

(65) Prior Publication Data

US 2023/0068659 A1 Mar. 2, 2023

(30) Foreign Application Priority Data

Aug. 30, 2021 (CN) ..... 202122073428.7

(51) Int. Cl.
*A47D 13/10* (2006.01)
*A47D 15/00* (2006.01)

(52) U.S. Cl.
CPC ..... *A47D 13/107* (2013.01); *A47D 15/00* (2013.01)

(58) Field of Classification Search
CPC ..... A47D 13/107; A47D 1/02; A47D 13/10; A47D 15/00; A47C 3/021
See application file for complete search history.

(56) References Cited

U.S. PATENT DOCUMENTS 2,509,451 A * 5/1950 Reinholz ..... A47C 3/023 297/440.11
3,235,306 A * 2/1966 Chernivsky ..... A47D 13/107 297/440.11
4,522,444 A * 6/1985 Pollock ..... A47C 3/021 297/440.11
5,360,258 A * 11/1994 Alivizatos ..... A47D 13/107 5/655
5,411,315 A * 5/1995 Greenwood ..... A47D 13/107 297/440.11
2014/0366276 A1* 12/2014 Chang ..... A47D 13/107 5/655

FOREIGN PATENT DOCUMENTS

GB 2507530 A * 5/2014 ..... A47D 1/02

* cited by examiner

*Primary Examiner* — Milton Nelson, Jr.

(57) ABSTRACT

A detachable baby bouncer is provided, including a U-shaped connecting tube having two connecting ends; a left support foot including a first connecting rod and a first support rod, the first connecting rod detachably connected to one connecting end; a right support foot including a second connecting rod and a second support rod, the second connecting rod detachably connected to the other connecting end; two connecting bases, one detachably connected to the first support rod, the other detachably connected to the second support rod; a U-shaped backrest tube including two first bent tubes and a connecting sleeve, one end of the first bent tube detachably connected to the connecting sleeve, the other end detachably connected to the connecting base. The technical solution of the present disclosure is intended to provide a detachable baby bouncer with a reduced packaging volume, a reduced packaging cost, and an increased container loading quantity.

10 Claims, 3 Drawing Sheets

DETACHABLE BABY BOUNCER

FIELD

The present disclosure relates to the technical field of infant bouncers, and particularly relates to a detachable baby bouncer.

BACKGROUND

Infant bouncer, which is used for infant entertainment, is a product assembled by multiple U-shaped tubes and connecting tubes.

However, in the process of realizing technical solutions of the present application, the present inventors have found that the above-mentioned technology has at least the technical problems as follows. The current infant bouncers are subject to a large packaging volume after disassembly, and the container loading quantity is small, thereby increasing packaging costs and transportation costs.

SUMMARY

An object of the present disclosure is to provide a detachable baby bouncer, which is intended to provide a detachable baby bouncer with a reduced packaging volume, a reduced packaging cost, and an increased container loading quantity.

In order to achieve the above object, the present disclosure proposes a detachable baby bouncer, including: a connecting tube which has a U-shape and two connecting ends; a left support foot including a first connecting rod and a first support rod which are integrally bent and formed, wherein the first connecting rod is detachably connected to one of the connecting ends; a right support foot including a second connecting rod and a second support rod which are integrally bent and formed, wherein the second connecting rod is detachably connected to the other connecting end; two connecting bases, one of the connecting bases being detachably connected to the first support rod, and the other connecting base being detachably connected to the second support rod; a backrest tube having a U-shape and including two first bent tubes and a connecting sleeve, wherein one end of the first bent tube is detachably connected to the connecting sleeve, and the other end of the first bent tube is detachably connected to the connecting base.

In an embodiment, the detachable baby bouncer further includes: a music bracket having a U-shape and including two second bent tubes and a connecting member, wherein one end of the second bent tube is detachably connected to the connecting member, the other end of the second bent tube is detachably connected to the connecting base, and two opposite inner sides of the connecting member are provided with mating grooves; and a music box with mating protrusions being provided on two opposite outer sides of the music box, wherein the mating protrusions and the mating grooves are in a plug connection.

In an embodiment, the connecting tube includes: a first tube section; two second tube sections, wherein the two second tube sections are located at two sides of the first tube section and are in a circular arc transition; and, two rear non-slip rubber, wherein each rear non-slip rubber is sleeved on an outer side of the connecting tube and is located at a transitional connection of the first tube section and the second tube section.

In an embodiment, the connecting tube further includes decorative covers detachably provided to the connecting tube and covering the rear non-slip rubber.

In an embodiment, the decorative cover has a first snap-fit portion and a second snap-fit portion, the first snap-fit portion being snap-fit connected to the first tube section, and the second snap-fit portion being snap-fit connected to the second tube section.

In an embodiment, the left support foot and the right support foot are respectively provided with front non-slip rubber, wherein one of the front non-slip rubber is provided at the transitional connection between the first connecting rod and the first support rod, and the other front non-slip rubber is provided at the transitional connection between the second connecting rod and the second support rod.

In an embodiment, the connecting sleeve is provided with two first through-holes, the first bent tube is provided with a first connecting hole, and the first bent tube and the connecting sleeve are detachably connected via an spring snap clip.

In an embodiment, the connecting member is provided with two second through-holes, and the second bent tube is provided with a second connecting hole, the second bent tube extending into an inside of the connecting member so that the second through-hole and the second connecting hole are aligned, and a connection between the second bent tube and the connecting member is realized by means of a threaded fastener.

In an embodiment, the connecting base is provided with a first installation channel, a second installation channel, and a third installation channel, wherein the first installation channel and the second installation channel are coaxially arranged, the third installation channel and the first installation channel are arranged at an angle, the other end of the first bent tube extends into the first installation channel and is detachably connected, the other end of the second bent tube extends into the second installation channel and is detachably connected, and the first support rod or the second support rod extends into the third installation channel and is detachably connected.

In an embodiment, the connections between the first bent tube and the connecting base, between the second bent tube and the connecting base, between the first support rod and the connecting base, and between the second support rod and the connecting base are achieved by means of a threaded fastener.

The technical solution of the present disclosure includes a connecting tube, a left support foot, a right support foot, a connecting base, and a backrest tube. The connecting tube is U-shaped, the connecting tube has two connecting ends, the left support foot includes a first connecting rod and a first support rod which are integrally bent and formed, the first connecting rod is detachably connected to a connecting end, the right support foot includes a second connecting rod and a second support rod which are integrally bent and formed, and the second connecting rod is detachably connected to the other connecting end; one of the connecting bases being detachably connected to the first support rod, and the other connecting base being detachably connected to the second support rod; the backrest tube has a U-shape and includes two first bent tubes and a connecting sleeve, wherein one end of the first bent tube is detachably connected to the connecting sleeve, and the other end of the first bent tube is detachably connected to the connecting base. Since the technical means that each component is detachably connected and the backrest tube is further disassembled into a plurality of parts is used, the technical problems of the related art that the infant bouncer has a large packaging volume after the disassembly, resulting in a small container loading quantity, a high packaging cost and a high transportation cost, are effectively solved, thereby achieving the technical effects of reducing the packaging volume, reducing the packaging cost, and increasing the container loading quantity.

BRIEF DESCRIPTION OF THE DRAWINGS

In order to explain the embodiments of the present disclosure or the technical solution in the related art more clearly, the following will briefly introduce the drawings that need to be used in the description of the embodiments or the related art. Obviously, the drawings in the following description are merely some embodiments of the present disclosure. For those of ordinary skills in the art, other drawings can be obtained according to the structure shown in these drawings without creative efforts.

Figure 1:
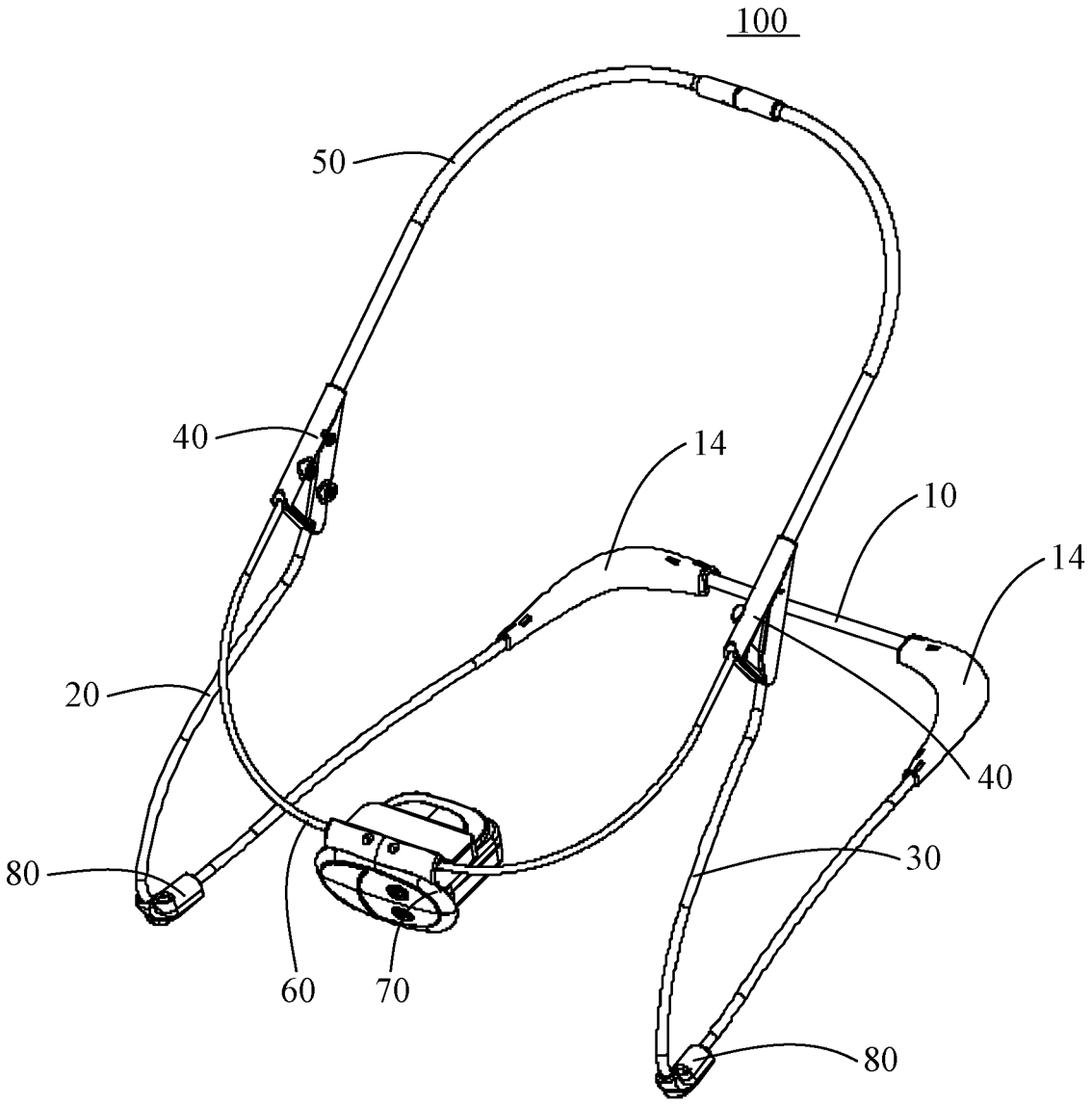
FIG. 1 is a schematic view of an assembly structure of an embodiment of a detachable baby bouncer of the present disclosure.

The description of reference numerals: detachable baby bouncer 100; connecting tube 10; first tube section 11; second tube section 12; rear non-slip rubber 13; decorative cover 14; left support foot 20; first connecting rod 21; first support rod 22; right support foot 30; second connecting rod 31; second support rod 32; connecting base 40; backrest tube 50; first bent tube 51; connecting sleeve 52; spring snap clip 53; snap joint 531; music bracket 60; second bent tube 61; connecting member 62; music box 70; front non-slip rubber 80.

The realization, functional features, and advantages of the object of the present disclosure will be further described with reference to the accompanying drawings in combination with the embodiments.

DETAILED DESCRIPTION

The technical solutions in the embodiments of the present disclosure will be clearly and completely described below in conjunction with the accompanying drawings in the embodiments of the present disclosure. Obviously, the described embodiments are only a part of the embodiments of the present disclosure, rather than all the embodiments. Based on the embodiments of the disclosure, all other embodiments obtained by a person of ordinary skills in the art without involving any inventive effort fall into the scope of the present disclosure.

It should be noted that all the directional indications (such as up, down, left, right, front, rear . . . ) in the embodiments of the present disclosure are only used to explain the relative positional relationship and movement between various components in a certain posture (as shown in the accompanying drawings). If the specific posture changes, the directional indication will also change accordingly.

In the present disclosure, unless otherwise clearly specified and defined, the terms "connect", "fix", etc. should be interpreted broadly. For example, "fix" can be a fixed connection, a detachable connection, or an integral connection; a mechanical connection or an electrical connection; a direct connection or an indirect connection through an intermediate medium, or an internal communication between two elements or the interaction between two elements unless otherwise clearly defined. It will be understood by those of ordinary skills in the art that the specific meanings of the above terms in the present disclosure may be understood according to specific circumstances.

In addition, descriptions in the present disclosure relating to "first", "second", etc. are merely for descriptive purposes and are not to be construed as indicating or implying a relative importance or implicitly indicating the number of technical features indicated. Therefore, a feature defined as "first" or "second" may explicitly or implicitly include at least one such feature. In addition, the technical solutions of the various embodiments can be combined with each other, but must be based on the fact that it can be realized by a person of ordinary skills in the art. When the combination of technical solutions is contradictory or cannot be achieved, it should be considered that such a combination of technical solutions does not exist, nor is it within the scope required by the present disclosure.

The present disclosure proposes a detachable baby bouncer 100.

In order to better understand the above technical solutions, the above technical solutions will be described in detail below in conjunction with the accompanying drawings of the description and specific implementation modes.

Figure 2:
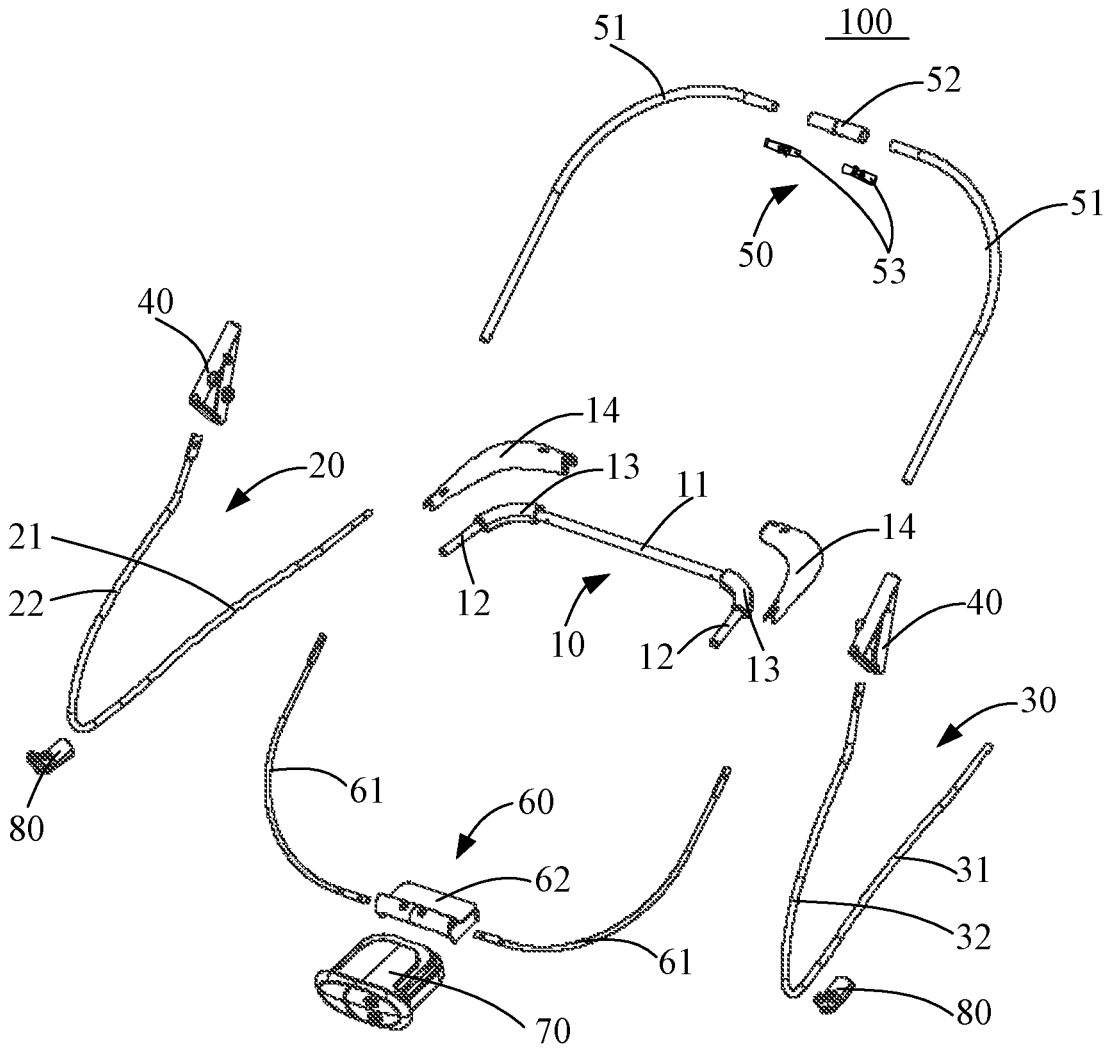
FIG. 2 is a schematic view of an exploded structure of an embodiment of a detachable baby bouncer of the present disclosure.

In an embodiment of the present disclosure, as shown in FIGS. 1 and 2, the detachable baby bouncer 100 includes a connecting tube 10, a left support foot 20, a right support foot 30, a connecting base 40 and a backrest tube 50. The connecting tube 10 is U-shaped, and the connecting tube 10 has two connecting ends; the left support foot 20 includes a first connecting rod 21 and a first support rod 22 which are integrally bent and formed, the first connecting rod 21 being detachably connected to a connecting end; the right support foot 30 includes a second connecting rod 31 and a second support rod 32 which are integrally bent and formed, the second connecting rod 31 being detachably connected to the other connecting end; there are two connecting bases 40, one connecting base 40 being detachably connected to the first support rod 22, and the other connecting base 40 being detachably connected to the second support rod 32; the backrest tube 50 is U-shaped, and the backrest tube 50 includes two first bent tubes 51 and a connecting sleeve 52, wherein one end of the first bent tube 51 is detachably connected to the connecting sleeve 52, and the other end of the first bent tube 51 is detachably connected to the connecting base 40.

It can be understood that the left support foot 20 and the right support foot 30 are located on the left side and right side of the connecting tube 10 to form a bottom support base, one side of the left support foot 20 and the right support foot 30 away from the connecting tube 10 is respectively connected to the connecting base 40, the backrest tube 50 is U-shaped and two ends thereof are respectively detachably connected to the connecting base 40, and the backrest tube 50 is arranged at an angle to the connecting tube 10 so as to facilitate the formation of a backrest part inclined to the ground after the backrest tube 50 is sleeved with cloth cover. In the packaging of the present disclosure, the connecting tube 10, the left support foot 20, the right support foot 30, the connecting base 40 and the backrest tube 50 are all in a disassembled state, and the backrest tube 50 is further disassembled into two first bent tubes 51 and a connecting sleeve 52, namely, the backrest tube 50 is in a disconnected design along an intermediate shaft and is assembled by a user himself during the use. By way of dispersing into a plurality of components and parts, the disclosure can reduce the packaging volume when packaging.

The technical solution of the present disclosure includes a connecting tube 10, a left support foot 20, a right support foot 30, a connecting base 40, and a backrest tube 50. The connecting tube 10 is U-shaped, the connecting tube 10 has two connecting ends, the left support foot 20 includes a first connecting rod 21 and a first support rod 22 which are integrally bent and formed, the first connecting rod 21 is detachably connected to a connecting end, the right support foot 30 includes a second connecting rod 31 and a second support rod 32 which are integrally bent and formed, and the second connecting rod 31 is detachably connected to the other connecting end; there are two connecting bases 40, one connecting base 40 being detachably connected to the first support rod 22, and the other connecting base 40 being detachably connected to the second support rod 32; the backrest tube 50 is U-shaped, and the backrest tube 50 includes two first bent tubes 51 and a connecting sleeve 52, wherein one end of the first bent tube 51 is detachably connected to the connecting sleeve 52, and the other end of the first bent tube 51 is detachably connected to the connecting base 40. Since the technical means that each component is detachably connected and the backrest tube 50 is further disassembled into a plurality of parts is used, the technical problems of the related art that the infant bouncer has a large packaging volume after the disassembly, resulting in a small container loading quantity, a high packaging cost and a high transportation cost, are effectively solved, thereby achieving the technical effects of reducing the packaging volume, reducing the packaging cost and increasing the container loading quantity.

In an embodiment of the present disclosure, the detachable baby bouncer 100 further includes a music bracket 60 and a music box 70. The music bracket 60 is U-shaped, the music bracket 60 includes two second bent tubes 61 and a connecting member 62, one end of the second bent tube 61 is detachably connected to the connecting member 62, the other end of the second bent tube 61 is detachably connected to the connecting base 40, and two opposite inner sides of the connecting member 62 are provided with mating grooves; mating protrusions are provided on two opposite outer sides of the music box 70, and the mating protrusions and the mating grooves are in a plug connection. When packaging, the music bracket 60 is disassembled into two bent tubes and a connecting member 62, namely, the music bracket 60 is in a disconnected design along an intermediate shaft, and is assembled by a user himself during the use; the music box 70 and the connecting member 62 are also in a disassembled state, and the music box 70 and the connecting member 62 are in a plug-in mating connection, namely, the music box 70 slides in from an opening at one end of a mating groove, so as to realize the mating installation of the music box 70 and the connecting member 62, without using a tool, which is convenient and quick.

In an embodiment of the present disclosure, as shown in FIGS. 1 and 2, the connecting tube 10 includes a first tube section 11, two second tube sections 12, and two rear non-slip rubber 13. The two second tube sections 12 are located at two sides of the first tube section 11 and are in a circular arc transition; the rear non-slip rubber 13 is sleeved on the outer side of the connecting tube 10 and is located at the transitional connection between the first tube section 11 and the second tube section 12. The first tube section 11 and the second tube section 12 are integrally bent and formed. The rear non-slip rubber 13 is made of a soft TPE material, and is sleeved on the outside of the connecting tube 10 to play an anti-slip function. At the time of packaging, the rear non-slip rubber 13 is mounted to the connecting tube 10.

In the embodiments of the present disclosure, as shown in FIGS. 1 and 2, the connecting tube 10 further includes a decorative cover 14 which is detachably provided on the connecting tube 10 and covers the rear non-slip rubber 13. The decorative cover 14 is for decorative purposes.

In an embodiment of the present disclosure, as shown in FIGS. 1 and 2, the decorative cover 14 has a first snap-fit portion and a second snap-fit portion, the first snap-fit portion being snap-fit connected to the first tube section 11, and the second snap-fit portion being snap-fit connected to the second tube section 12. The assembly and disassembly are facilitated by means of snap-fit mating. When packaging is performed, the decorative cover 14 and the connecting tube 10 are in a disassembled state, and a user can install it by himself according to requirements during the use.

In an embodiment of the present disclosure, as shown in FIGS. 1 and 2, the left support foot 20 and the right support foot 30 are respectively provided with front non-slip rubber 80, one front non-slip rubber 80 is provided at the transitional connection between the first connecting rod 21 and the first support rod 22, and the other front non-slip rubber 80 is provided at the transitional connection between the second connecting rod 31 and the second support rod 32. The front non-slip rubber 80 is made of a soft TPE material, and is sleeved at the transitional connection of the left support foot 20 or the right support foot 30 to play an anti-slip function. The rear non-slip rubber 13 is installed on the left support foot 20 and the right support foot 30 at the time of packaging.

Figure 3:
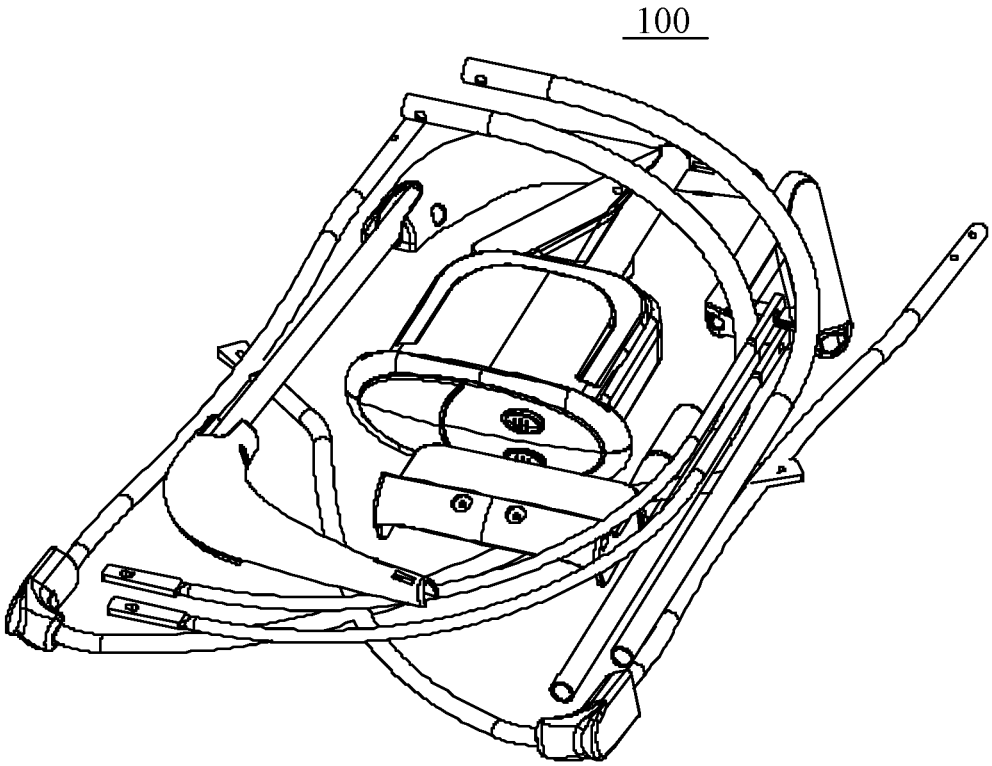
FIG. 3 is a schematic view of a structure when the detachable baby bouncer of the present disclosure is packaged.

In an embodiment of the present disclosure, at the time of packaging, the connecting tube 10, the left support foot 20, the right support foot 30, the connecting base 40, the backrest tube 50, the music bracket 60, the music box 70, the decorative cover 14, the front non-slip rubber 80, and the rear non-slip rubber 13 are disassembled to be in a disassembled state as shown in FIG. 3 so that the packaging volume can be reduced.

Figure 4:
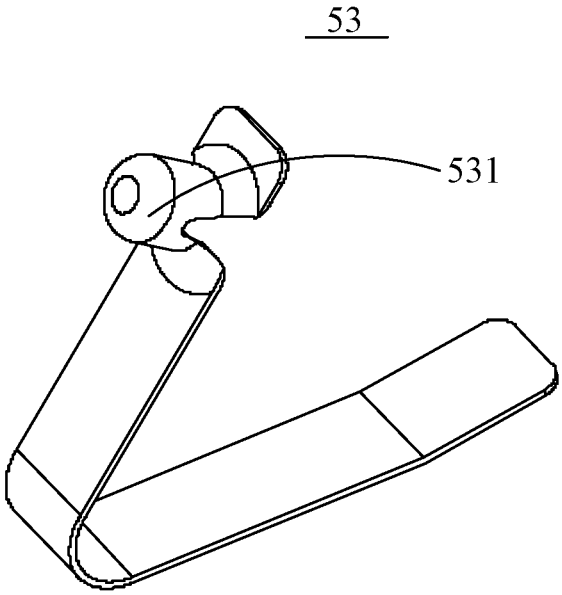
FIG. 4 is a schematic view of the structure of a snap joint of the present disclosure.

In an embodiment of the present disclosure, as shown in FIG. 2, the connecting sleeve 52 is provided with two first through-holes, the first bent tube 51 is provided with a first connecting hole, and the first bent tube 51 and the connecting sleeve 52 are detachably connected via an spring snap clip 53. As shown in FIG. 4, the spring snap clip 53 includes a first spring snap clip and a second spring snap clip with an included angle. The first spring snap clip has a snap joint 531; under the squeezing of an external force, the included angle between the first spring snap clip and the second spring snap clip becomes smaller; when the external force disappears, the spring snap clip 53 can recover under the action of its own elastic force; the spring snap clip 53 is provided inside the first bent tube 51, and the snap joint 531 extends out of the first connecting hole under the action of the elastic force; when the connecting sleeve 52 and the first bent tube 51 are fitted, the connecting sleeve 52 is sleeved on the outside of the first bent tube 51, and through squeezing, the snap joint 531 is made enter the first bent tube 51; when the first through-hole and the first connecting hole are aligned, the snap joint 531 passes through the first connecting hole and the first through-hole successively under the action of elastic force to realize the fitting connection of the first bent tube 51 and the connecting sleeve 52; when disassembly is required, the connecting sleeve 52 and the first bent tube 51 can be disassembled by merely pressing the snap joint 531 protruding outside the connecting sleeve 52.

In an embodiment of the present disclosure, as shown in FIG. 2, the connecting member 62 is provided with two second through-holes, and the second bent tube 61 is provided with a second connecting hole, the second bent tube 61 extending into the inside of the connecting member 62 so that the second through-hole and the second connecting hole are aligned, and the connection between the second bent tube 61 and the connecting member 62 is realized by means of a threaded fastener.

In an embodiment of the present disclosure, the connecting base 40 is provided with a first installation channel, a second installation channel, and a third installation channel. The first installation channel and the second installation channel are coaxially arranged, the third installation channel and the first installation channel are arranged at an angle, the other end of the first bent tube 51 extends into the first installation channel and is detachably connected, the other end of the second bent tube 61 extends into the second installation channel and is detachably connected, and the first support rod 22 or the second support rod 32 extends into the third installation channel and is detachably connected. The outside of the connecting base 40 has a triangular shape, and the first installation channel and the second installation channel are arranged along a right-angled side of the triangular shape, and the third installation channel is arranged along an oblique side of the triangular shape.

In an embodiment of the present disclosure, the connections between the first bent tube 51 and the connecting base 40, between the second bent tube 61 and the connecting base 40, between the first support rod 22 and the connecting base 40, and between the second support rod 32 and the connecting base 40 are realized by means of a threaded fastener.

The above description is merely an optional embodiment of the present disclosure, and does not limit the scope of the patent of the present disclosure. Under the inventive concept of the present disclosure, any equivalent structural change made by using the contents of the description and the accompanying drawings of the present disclosure, or direct/indirect application in other relevant technical fields is included in the scope of the patent protection of the present disclosure.

What is claimed is:

1. A detachable baby bouncer, comprising:

a connecting tube which has a U-shape and two connecting ends;

a left support foot comprising a first connecting rod and a first support rod which are integrally bent and formed, wherein the first connecting rod is detachably connected to one of the connecting ends;

a right support foot comprising a second connecting rod and a second support rod which are integrally bent and formed, wherein the second connecting rod is detachably connected to the other connecting end;

two connecting bases, one of the connecting bases being detachably connected to the first support rod, and the other connecting base being detachably connected to the second support rod; and a backrest tube having a U-shape and comprising two first bent tubes and a connecting sleeve, wherein one end of the first bent tube is detachably connected to the connecting sleeve, and the other end of the first bent tube is detachably connected to the connecting base.

2. The detachable baby bouncer according to claim 1, wherein the connecting sleeve is provided with two first through-holes, the first bent tube is provided with a first connecting hole, and the first bent tube and the connecting sleeve are detachably connected via a spring snap clip.

3. The detachable baby bouncer according to claim 1, wherein the connecting tube comprises:

a first tube section;

two second tube sections, wherein the two second tube sections are located at two sides of the first tube section and are in a circular arc transition; and two rear non-slip rubber members, wherein each rear non-slip rubber members is sleeved on an outer side of the connecting tube and is located at a transitional connection of the first tube section and the second tube section.

4. The detachable baby bouncer according to claim 3, wherein the connecting tube further comprises decorative covers detachably provided to the connecting tube and covering the rear non-slip rubber members.

5. The detachable baby bouncer according to claim 4, wherein the decorative cover has a first snap-fit portion and a second snap-fit portion, the first snap-fit portion being snap-fit connected to the first tube section, and the second snap-fit portion being snap-fit connected to the second tube section.

6. The detachable baby bouncer according to claim 1, wherein the left support foot and the right support foot are respectively provided with front non-slip rubber members, wherein one of the front non-slip rubber members is provided at a transitional connection between the first connecting rod and the first support rod, and the other front non-slip rubber is provided at the transitional connection between the second connecting rod and the second support rod.

7. The detachable baby bouncer according to claim 1, further comprising:

a music bracket having a U-shape and comprising two second bent tubes and a connecting member, wherein one end of the second bent tube is detachably connected to the connecting member, the other end of the second bent tube is detachably connected to the connecting base, and two opposite inner sides of the connecting member are provided with mating grooves; and a music box with mating protrusions being provided on two opposite outer sides of the music box, wherein the mating protrusions and the mating grooves are in a plug connection.

8. The detachable baby bouncer according to claim 7, wherein the connecting member is provided with two second through-holes, and the second bent tube is provided with a second connecting hole, the second bent tube extending into an inside of the connecting member so that the second through-hole and the second connecting hole are aligned, and a connection between the second bent tube and the connecting member is realized by means of a threaded fastener.

9. The detachable baby bouncer according to claim 7, wherein the connecting base is provided with a first installation channel, a second installation channel, and a third installation channel, wherein the first installation channel and the second installation channel are coaxially arranged, the third installation channel and the first installation channel are arranged at an angle, the other end of the first bent tube extends into the first installation channel and is detachably connected, the other end of the second bent tube extends into the second installation channel and is detachably connected, and the first support rod or the second support rod extends into the third installation channel and is detachably connected.

10. The detachable baby bouncer according to claim 9, wherein the connections between the first bent tube and the connecting base, between the second bent tube and the connecting base, between the first support rod and the connecting base, and between the second support rod and the connecting base are achieved by means of a threaded fastener.

* * * * *